US011441808B2

(12) United States Patent
Mori et al.

(10) Patent No.: US 11,441,808 B2
(45) Date of Patent: Sep. 13, 2022

(54) AIR-CONDITIONING APPARATUS AND AIR-CONDITIONING METHOD

(71) Applicant: Mitsubishi Electric Corporation, Tokyo (JP)

(72) Inventors: Yuki Mori, Tokyo (JP); Masashi Fujitsuka, Tokyo (JP); Takahiro Nakai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 135 days.

(21) Appl. No.: 17/054,829

(22) PCT Filed: Jul. 18, 2018

(86) PCT No.: PCT/JP2018/026889
§ 371 (c)(1),
(2) Date: Nov. 12, 2020

(87) PCT Pub. No.: WO2020/016959
PCT Pub. Date: Jan. 23, 2020

(65) Prior Publication Data

US 2021/0215385 A1 Jul. 15, 2021

(51) Int. Cl.
*F24F 11/86* (2018.01)
*F25B 13/00* (2006.01)

(52) U.S. Cl.
CPC ..... *F24F 11/86* (2018.01); *F25B 13/00* (2013.01)

(58) Field of Classification Search
CPC ..... F24F 11/86; F24F 2110/10; F25B 2313/0233; F25B 2313/0314; F25B 2700/2104; F25B 49/02
See application file for complete search history.

(56) References Cited

U.S. PATENT DOCUMENTS

2013/0055751 A1* 3/2013 Inaba ..... F25B 5/04 62/498
2013/0111929 A1* 5/2013 Jekimow ..... F25B 41/34 62/56

(Continued)

FOREIGN PATENT DOCUMENTS

JP H08-028983 A 2/1996
JP H11-325638 A 11/1999

(Continued)

OTHER PUBLICATIONS

Examination Report dated Sep. 8, 2021 issued in corresponding AU patent application No. 2018432700.

(Continued)

*Primary Examiner* — Henry T Crenshaw
(74) *Attorney, Agent, or Firm* — Posz Law Group, PLC

(57) ABSTRACT

An air-conditioning apparatus includes: room temperature sensors; room temperature setting units; a compressor that causes refrigerant to circulate through an outdoor heat exchanger, electric expansion valves, and indoor heat exchangers; a calculation unit including an integrator for a temperature deviation; an output unit that outputs a total opening degree; a calculation unit that uses a required capacity and the total opening degree; a derivation unit that obtains a distance function with a valve opening degree and a temporary valve opening degree as an evaluation function; a derivation unit that obtains equality constraints for equalizing the sum of opening degrees as a variable to the total opening degree; a calculation unit that calculates upper and lower limits of each opening degree; a derivation unit that obtains inequality constraints in which each opening degree falls within the range between the upper and lower limits; and a calculation unit that calculates the opening degrees from the evaluation function and the equality and inequality (Continued)

constraints, whereby the room temperature deviation can be made to approach the minimum value.

8 Claims, 4 Drawing Sheets

(56) References Cited

U.S. PATENT DOCUMENTS

2016/0297283 A1* 10/2016 Sakamoto ..... F25B 47/02
2018/0372379 A1* 12/2018 Kamitani ..... F25B 49/02

FOREIGN PATENT DOCUMENTS

JP 2002-054836 A 2/2002
JP 2005-147541 A 6/2005

OTHER PUBLICATIONS

International Search Report of the International Searching Authority dated Sep. 4, 2018 for the corresponding International application No. PCT/JP2018/026889 (and English translation).
Extended European Search Report dated Jun. 29, 2021, issued in corresponding European Application No. 18926483.1.

* cited by examiner

AIR-CONDITIONING APPARATUS AND AIR-CONDITIONING METHOD

CROSS REFERENCE TO RELATED APPLICATION

This application is a U.S. national stage application of PCT/JP2018/026889 filed on Jul. 18, 2018, the contents of which are incorporated herein by reference.

TECHNICAL FIELD

The present disclosure relates to an air-conditioning apparatus including an outdoor unit that supplies refrigerant to a plurality of indoor heat exchangers, and to an air-conditioning method.

BACKGROUND ART

In an existing air-conditioning apparatus including an outdoor unit that supplies refrigerant to a plurality of indoor heat exchangers, the opening degree of each of electric expansion valves is determined based on a load, a refrigerant temperature, and operation conditions in order to perform a control for causing a room temperature of each room to reach a target room temperature, while keeping the state of the refrigerant appropriate in a refrigeration cycle.

For example, in Patent Literature 1, a discharge temperature is controlled based on the total opening degree of electric expansion valves connected to respective indoor heat exchangers. The variation of the total opening degree of the electric expansion valves is divided and assigned to the electric expansion valves based on a ratio of a current air-conditioning capacity to a target air-conditioning capacity that is determined depending on the deviation of a room temperature from a target room temperature.

In Patent Literature 2, in order to keep a suction refrigerant state of a compressor appropriate, upper and lower limits of the opening degree of an electric expansion valve are variable depending on operation conditions.

In Patent Literature 3, the total opening degree of electric expansion valves is determined such that the degree of subcooling at an outdoor unit reaches a target degree of subcooling, and opening degrees of indoor heat exchangers that are determined based on a capacity ratio between the indoor heat exchangers are each corrected based on the difference between the degree of superheat and the target degree of superheat at each indoor heat exchanger.

CITATION LIST

Patent Literature

Patent Literature 1: Japanese Unexamined Patent Application Publication No. 8-28983

Patent Literature 2: Japanese Unexamined Patent Application Publication No. 2005-147541

Patent Literature 3: Japanese Unexamined Patent Application Publication No. 2002-54836

SUMMARY OF INVENTION

Technical Problem

In such an air-conditioning apparatus, it is not ensured that the deviation of the room temperature from the target room temperature is minimized, since connected indoor heat exchangers differ from each other in type or installation condition. For example, in Patent Literature 1, in the case where all the indoor heat exchangers are the same as each other regarding the difference between a suction temperature and a blowing temperature or the degree of superheat, the deviation of the room temperature from the target temperature is not reduced except for the case where the room temperature is coincident with the target room temperature. Furthermore, in the case where an element limiting a driving range of the opening degree of the electric expansion valve is added in order to keep the state of the refrigerant appropriate as in Patent Literature 2, a control performance for the room temperature and the discharge temperature is deteriorated, and controls cannot be performed in parallel. In addition, in the case where the degree of superheat is controlled as in Patent Literature 3, the degree of superheat on the suction side of a compressor cannot be controlled, an energy saving performance may be deteriorated and an operation range may be limited.

The present disclosure is applied to solve the above problems, and an object described in the present disclosure is to cause a room temperature deviation to approach a minimum value while achieving a high-efficiency operation even in the case where a driving range of the opening degree of the electric expansion valve is limited, or even in the case where installation conditions vary.

Solution to Problem

An air-conditioning apparatus according to an embodiment of the present disclosure includes: room temperature sensors that detects room temperatures of respective rooms; target room-temperature setting units that sets target room temperature of the respective rooms; a variable displacement type compressor that causes refrigerant to sequentially circulate through an outdoor heat exchanger, electric expansion valves, and indoor heat exchangers; a required-capacity calculation unit that calculates each of required capacities for the respective rooms using a value that is obtained by integrating a deviation of an associated one of the room temperatures from an associated one of the target room temperatures; an electric expansion-valve total opening degree output unit that outputs a total opening degree of the electric expansion valves, each of which is connected to an associated one of the indoor heat exchangers; a temporary electric expansion-valve opening degree calculation unit that calculates each of temporary opening degrees of the electric expansion valves for the respective rooms, using an associated one of the required capacities and the total opening degree; an evaluation function derivation unit that obtains a distance function with an associated one of the temporary opening degrees of the electric expansion valves, as an evaluation function, using an associated one of opening degrees of the electric expansion valves as a variable; an equality constraint derivation unit that obtains equality constraints to equalize the sum of the opening degrees that is a variable to the total opening degree; an electric expansion-valve opening degree upper/lower limit calculation unit that calculates an upper limit and a lower limit of each of the opening degrees; an inequality constraint derivation unit that obtains inequality constraints in which each of the opening degrees meets falls within a range of the upper limit to the lower limit; and an optimization problem calculation unit that calculates each of the opening degrees by solving an optimization problem from the evaluation function, the equality constraints, and the inequality constraints.

An air-conditioning method according to another embodiment of the present disclosure includes: a room temperature detection step of detecting room temperatures of a plurality of rooms; a target room temperature setting step of setting target room temperatures of the plurality of rooms; a circulation step of causing refrigerant to sequentially circulate an outdoor heat exchanger, electric expansion valves, and indoor heat exchangers, using a variable displacement type compressor; a required capacity calculation step of calculating each of required capacities for the plurality of rooms, using a value that is obtained by integrating a deviation of an associated one of the room temperatures from an associated one of the target room temperatures; an electric expansion-valve total opening degree output step of outputting a total opening degree of the electric expansion valves, each of which is connected to an associated one of the indoor heat exchangers; a temporary electric expansion-valve opening degree calculation step of calculating a temporary electric expansion-valve opening degree of each of the plurality of rooms by using the corresponding required capacity and the total opening degree; an evaluation function derivation step of obtaining a distance function with the an associated one of the temporary opening degrees of the electric expansion valves as an evaluation function, using an associated one of the opening degrees of the electric expansion valves as a variable; an equality constraint derivation step of obtaining equality constraints to equalize the sum of the opening degrees as a variable to the total opening degree; an electric expansion-valve opening degree upper/lower limit calculation step of calculating an upper limit and a lower limit of each of the opening degrees; an inequality constraint derivation step of deriving inequality constraints in which each of the opening degrees falls within a range of the upper limit to the lower limit; and an optimization problem calculation step of calculating each of the opening degrees by solving an optimization problem from the evaluation function, the equality constraints, and the inequality constraints.

Advantageous Effects of Invention

According to the embodiments of the present disclosure, it is possible to cause a room temperature deviation to approach the minimum value while achieving a high-efficiency operation within an allowable driving range of the electric expansion-valve opening degree.

DESCRIPTION OF EMBODIMENTS

Embodiment 1

Figure 1:
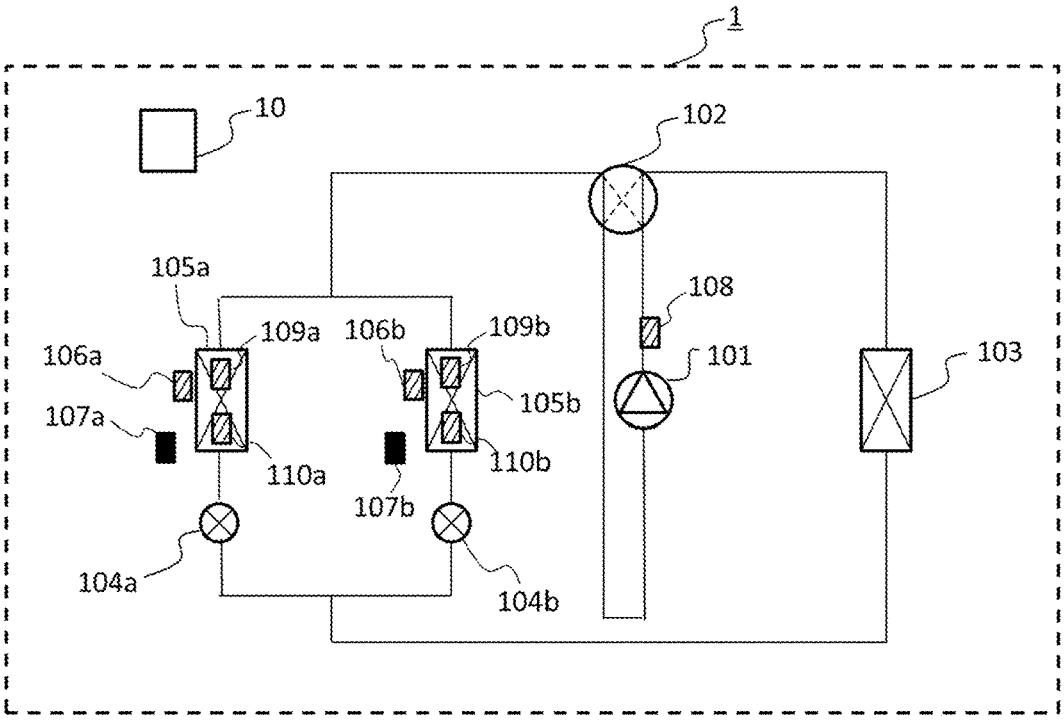
FIG. 1 is a schematic diagram of an air-conditioning apparatus according to Embodiment 1 of the present disclosure.

FIG. 1 is a schematic diagram of an air-conditioning apparatus 1 according to Embodiment 1 of the present disclosure. In the air-conditioning apparatus 1, a variable displacement compressor 101, a four-way valve 102, an outdoor heat exchanger 103, electric expansion valves 104*a* and 104*b*, and indoor heat exchangers 105*a* and 105*b* are sequentially connected by pipes. Regarding Embodiment 1, FIG. 1 illustrates two indoor heat exchangers 105*a* and 105*b*; however, three or more indoor heat exchangers may be connected. It should be noted that suffixes a and b of reference signs are used to distinguish components related to respective rooms from each other; that is, each of the suffixes a and b is used to indicate components related to an associated room. Embodiment 1 will be described by referring to by way of example the case where two rooms are present.

In a cooling cycle, refrigerant discharged from the compressor 101 passes through the four-way valve 102 in the direction indicated by each of solid lines, and transfers heat in the outdoor heat exchanger 103. The refrigerant that has passed through the outdoor heat exchanger is reduced in pressure by the electric expansion valves 104*a* and 104*b* to change into low-temperature two-phase refrigerant. The low-temperature two-phase refrigerant receives heat at the indoor heat exchangers 105*a* and 105*b*. The refrigerant that has received heat at the indoor heat exchangers 105*a* and 105*b* is sucked into the compressor 101.

In a heating cycle, the refrigerant discharged from the compressor 101 passes through the four-way valve 102 in the direction indicated by each of dashed lines, and transfers heat at the indoor heat exchangers 105*a* and 105*b*. The refrigerant that has transferred heat at the indoor heat exchangers 105*a* and 105*b* is reduced in pressure by the electric expansion valves 104*a* and 104*b* to change into low-temperature two-phase refrigerant. The low-temperature two-phase refrigerant receives heat at the outdoor heat exchanger 103. The refrigerant that has passed through the outdoor heat exchanger is sucked into the compressor 101.

To a suction side of the compressor 101, an accumulator may be connected. Furthermore, a receiver may be connected between the outdoor heat exchanger 103 and the electric expansion valves 104, and an electric expansion valve may be connected between the receiver and the outdoor heat exchanger 103.

The air-conditioning apparatus 1 includes a controller 10. The controller 10 acquires sensor values from various kinds of sensors such as room temperature sensors 106*a* and 106*b*, a discharge temperature sensor 108, degree-of-superheat sensors 109*a* and 109*b*, and degree-of-subcooling sensors 110*a* and 110*b*. In addition, the controller 10 acquires target room temperatures for the indoor heat exchangers 105*a* and 105*b*, from target room-temperature setting units 107*a* and 107*b* such as remote control units each of which allows a user to set a desired room temperature. The room temperature may be set not by the user, but also by a high-order control system or similar systems.

The controller 10 determines a frequency of the compressor 101 and operation amounts of the electric expansion valves 104*a* and 104*b* based on the sensor values from the various kinds of sensors as described above and the target room temperatures set by the target room-temperature setting units 107*a* and 107*b*.

Figure 2:
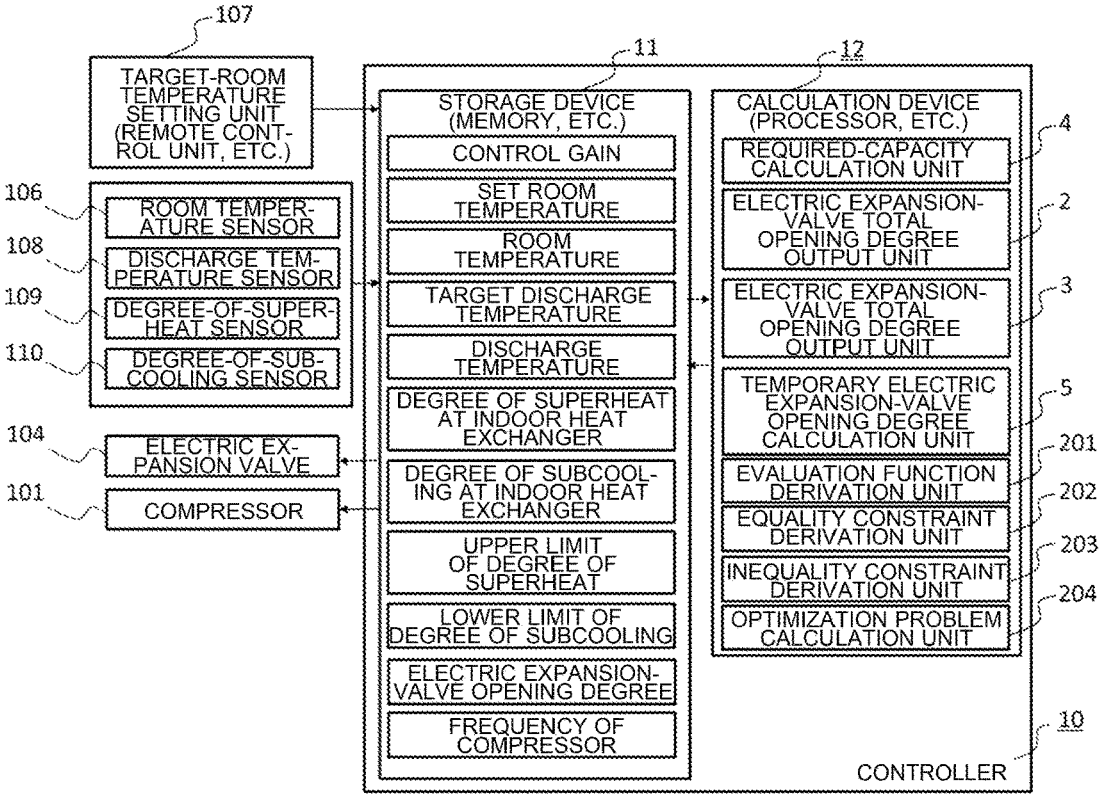
FIG. 2 is a diagram illustrating a configuration of a controller according to Embodiment 1 of the present disclosure.

FIG. 2 is a diagram illustrating a configuration of the controller according to Embodiment 1 of the present disclosure. The controller 10 includes a storage device 11 such as a memory, and an arithmetic device 12 such as a processor. The storage device 11 stores the target room temperatures (set room temperatures) set by the target room-temperature setting units 107 for respective rooms (room a and room b in Embodiment 1). Furthermore, the storage device 11 stores sensor values of the discharge temperature sensor 108, the room temperature sensors 106, the degree-of-superheat sensors 109, and the degree-of-subcooling sensors 110. The discharge temperature sensor 108 measures the discharge temperature of the refrigerant. The room temperature sensors 106 measure the room temperatures of the rooms. The degree-of-superheat sensors 109 measure the degrees of superheat at the indoor heat exchangers provided in the respective rooms. The degree-of-subcooling sensors 110 measure the degrees of subcooling at the indoor heat exchangers in the respective rooms. Furthermore, the storage device 11 stores a control gain, an upper limit of the degree of superheat, and a lower limit of the degree of subcooling.

The arithmetic device 12 performs a calculation using numerical values stored in the storage device 11, and outputs the opening degrees of the electric expansion valves, the frequency of the compressor, and the target discharge temperature. The data on the opening degrees of the electric expansion valves, the frequency of the compressor and the target discharge temperature that is output by the arithmetic device 12 is stored in the storage device 11, and is used to drive the electric expansion valves 104 and the compressor 101 of the air-conditioning apparatus 1.

The arithmetic device 12 includes, for example, an electric expansion-valve total opening degree output unit 2, an electric expansion-valve opening degree upper/lower limit calculation unit 3, a required-capacity calculation unit 4, a temporary electric expansion-valve opening degree calculation unit 5, an evaluation function derivation unit 201, an equality constraint derivation unit 202, an inequality constraint derivation unit 203, and an optimization problem calculation unit 204. The setting and names of the above units are determined merely as a matter of convenience for explanation. That is, larger units may be provided in place of the above units.

Figure 3:
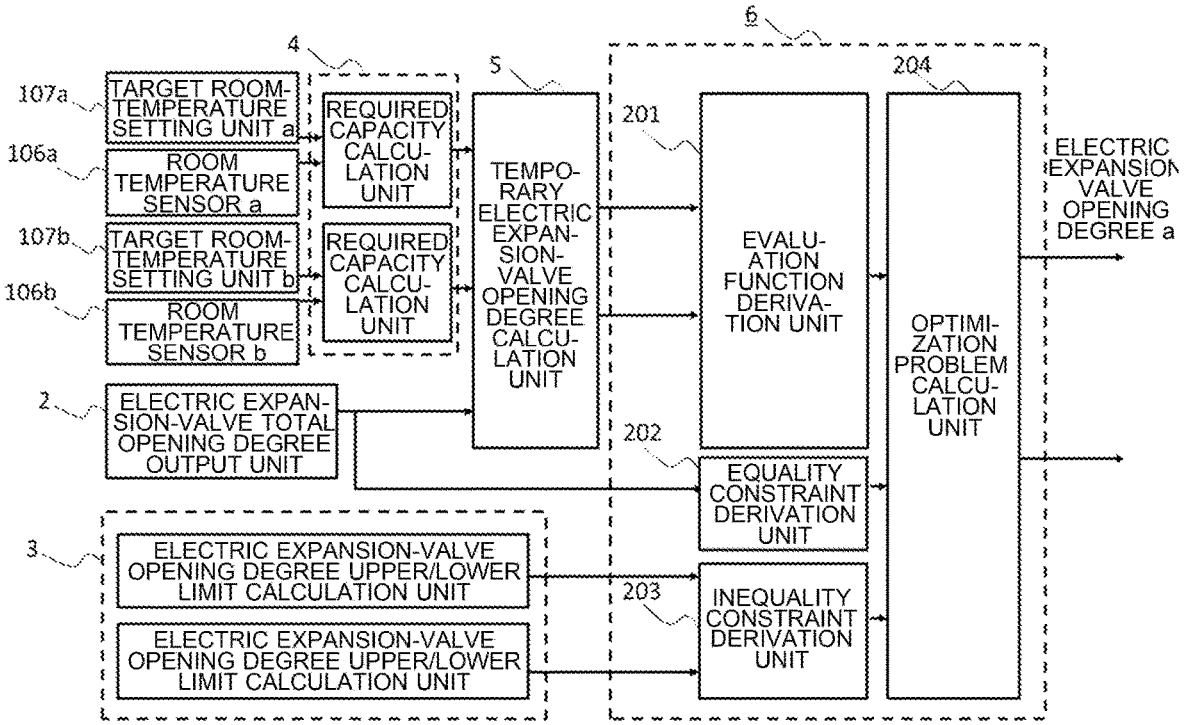
FIG. 3 is a diagram illustrating a control flow according to Embodiment 1 of the present disclosure.

FIG. 3 is a diagram illustrating a control flow according to Embodiment 1 of the present disclosure. For example, the required-capacity calculation unit 4 receives an output from the target temperature setting unit 107*a* and an output from the room temperature sensor 106*a*, and outputs a required capacity of the indoor heat exchanger 105*a*. Likewise, regarding the other room, the required-capacity calculation unit 4 receives an output from the target temperature setting unit 107*b* and an output from the room temperature sensor 106*b*, and outputs a required capacity of the indoor heat exchanger 105*b*. The temporary electric expansion-valve opening degree calculation unit 5 receives as the total opening degree of the electric expansion valves, an electric expansion-valve total opening degree that is output from the electric expansion-valve total opening degree output unit 2, and the required capacities of the indoor heat exchangers 105. The temporary electric expansion-valve opening degree calculation unit 5 outputs temporary electric expansion valve opening degrees as temporary opening degrees of the electric expansion valves. The electric expansion-valve opening degree upper/lower limit calculation unit 3 outputs electric expansion-valve opening degree upper and lower limits associated with the rooms, as upper and lower limits of the opening degrees of the electric expansion valves associated with the respective rooms.

The electric expansion-valve opening degree calculation unit 6 includes the evaluation function derivation unit 201, the equality constraint derivation unit 202, and the inequality constraint derivation unit 203. The evaluation function derivation unit 201 obtains an evaluation function from the temporary electric expansion-valve opening degrees output by the temporary electric expansion-valve opening degree calculation unit 5, and outputs the evaluation function. The equality constraint derivation unit 202 obtains an equality constraint from the electric expansion-valve total opening degree output by the electric expansion-valve total opening degree output unit 2, and outputs the equality constraint. The inequality constraint derivation unit 203 obtains an inequality constraint from the electric expansion-valve opening degree upper and lower limits output by the electric expansion-valve opening degree upper/lower limit calculation unit 3, and outputs the inequality constraint.

The optimization problem calculation unit 204 calculates electric expansion-valve opening degrees that are opening degrees of the electric valves, as the solution of an optimization problem including the evaluation function, the equality constraints, and the inequality constraints, and outputs the electric expansion-valve opening degrees as outputs of the electric expansion-valve opening degree calculation unit 6.

Figure 4:
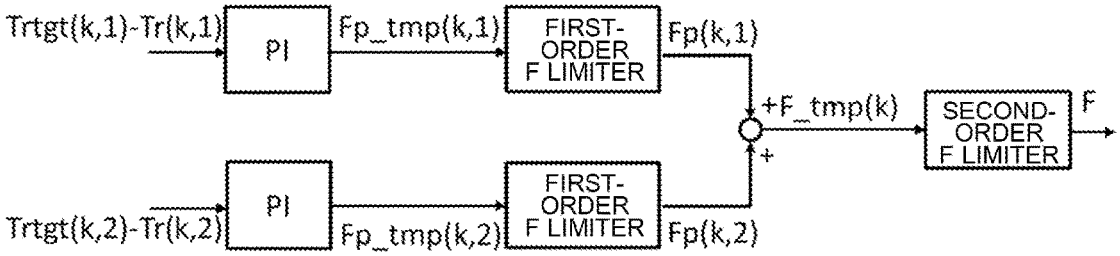
FIG. 4 is a block diagram illustrating a unit that calculates a frequency that is output by a frequency output unit in Embodiment 1 of the present disclosure.

FIG. 4 is a block diagram illustrating a unit that calculates a frequency that is output by a frequency output unit in Embodiment 1 of the present disclosure. First, each of room temperature deviations is applied as an input, and a temporary partial frequency is determined by an equation 1 and is output. It should be noted that each of the room temperature deviations is the difference between the room temperature of an associated room and the target room temperature (set room temperature) of the associated room.

[Math 1]

$$Fp_tmp(k,i)=Kp_F(Trtgt(k,i)-Tr(k,i))+Ki_F\Sigma_{l=0}^{k}(Trtgt(l,i)-Tr(l,i))Ts, i=1,2 \quad (1)$$

In the equation, k is a discrete time; i is a room number, and in this example, i is a room number of each of two rooms; $F_{p_tmp}$ is the temporary partial frequency, $K_{pF}$ is a proportional gain, $K_{iF}$ is an integral gain, $T_{rtgt}$ is a target room temperature, $T_r$ is a room temperature, and $T_s$ is a control period.

When the temporary partial frequency is calculated by a controller including an integrator in the above manner, it is possible to determine a frequency that is required by each of the indoor heat exchangers 105, while reducing a disturbance that is caused by a change in indoor heat load, the difference in installation condition between the indoor heat exchangers, the variation between hardware, etc. In the case where each of actuators operates within a range between upper and lower limits, it is possible to ensure that the room temperature approaches the target room temperature. In addition, as described above, each of the indoor heat exchangers 105 has a partial frequency, and can thus be automatically given the magnitude of a frequency change when the number of indoor units is changed.

Next, the temporary partial frequency passes through a first-order F limiter, and a partial frequency is determined by an equation 2 and is output.

[Math 2]

$$Fp(k, i) = \begin{cases} Fp\max_c & \text{if } Fp_tmp(k, i) > Fp\max_c \\ Fp\min(k) & \text{if } Fp_tmp(k, i) < Fp\min(k) \\ Fp_tmp(k, i) & \text{otherwise} \end{cases} \quad (2)$$

In the equation, $F_{pmax_c}$ is a previously determined constant. Since upper and lower limits are set, it is possible to possible to avoid the required frequency from becoming a negative value or an excess value. Furthermore, $F_{pmin}$ is calculated using an equation 3, from the frequency, the electric expansion-valve total opening degree, and an electric expansion-valve opening degree lower limit that is a lower limit of the opening degree of the electric expansion valve.

[Equation 3]

$$Fp\min(k, i) = F(k-1)\frac{Cp\min(k-1, i)}{C(k-1)} \quad (3)$$

In the equation, F is the frequency, $C_{pmin}$ is the electric expansion-valve opening degree lower limit, and C is the electric expansion-valve total opening degree, and a calculation method using these elements will be described later. Since the lower limit of the first-order F limiter is calculated in the above manner, in the case where an electric expansion valve is operated, with the opening degree of the electric expansion valve set to the lower limit, the temporary partial frequency associated with the electric expansion valve is greater than or equal to the temporary partial frequency in a one-previous step. As a result, it is possible to avoid a failure of cooling during the cooling operation, and to avoid a failure of heating during the heating operation.

Next, a temporary frequency is calculated using an equation 4, as the total sum of the partial frequencies.

[Equation 4]

$$F_tmp(k)=\Sigma_{l=1}{}^{2}Fp(k,l) \quad (4)$$

In the equation, $F_{_tmp}$ is the temporary frequency. Finally, the temporary frequency is applied as an input, and a frequency is determined by an equation 5 and is output.

[Equation 5]

$$F(k) = \begin{cases} F\max_c & \text{if } F_tmp(k) > F\max_c \\ F\min_c & \text{if } F_tmp(k) < F\min_c \\ F_tmp(\mathrm{k}) & \text{otherwise} \end{cases} \quad (5)$$

In the equation, F is the frequency, $F_{max_c}$ is a maximum frequency determined in advance, and $F_{min_c}$ is a minimum frequency determined in advance.

In the example as illustrated in FIG. 4, a PI controller is used to calculate the temporary partial frequency $F_{p_tmp}$; however, the control to be applied is not limited to the PI control. For example, the control to be applied may be an I control, a PID control, an LQI control, a model predictive control with an integrator, or a two-degree-of-freedom control, or may be a control method including upper and lower limits and anti-reset windup processing of an integrator in addition to basic configurations of the above controls.

Figure 5:
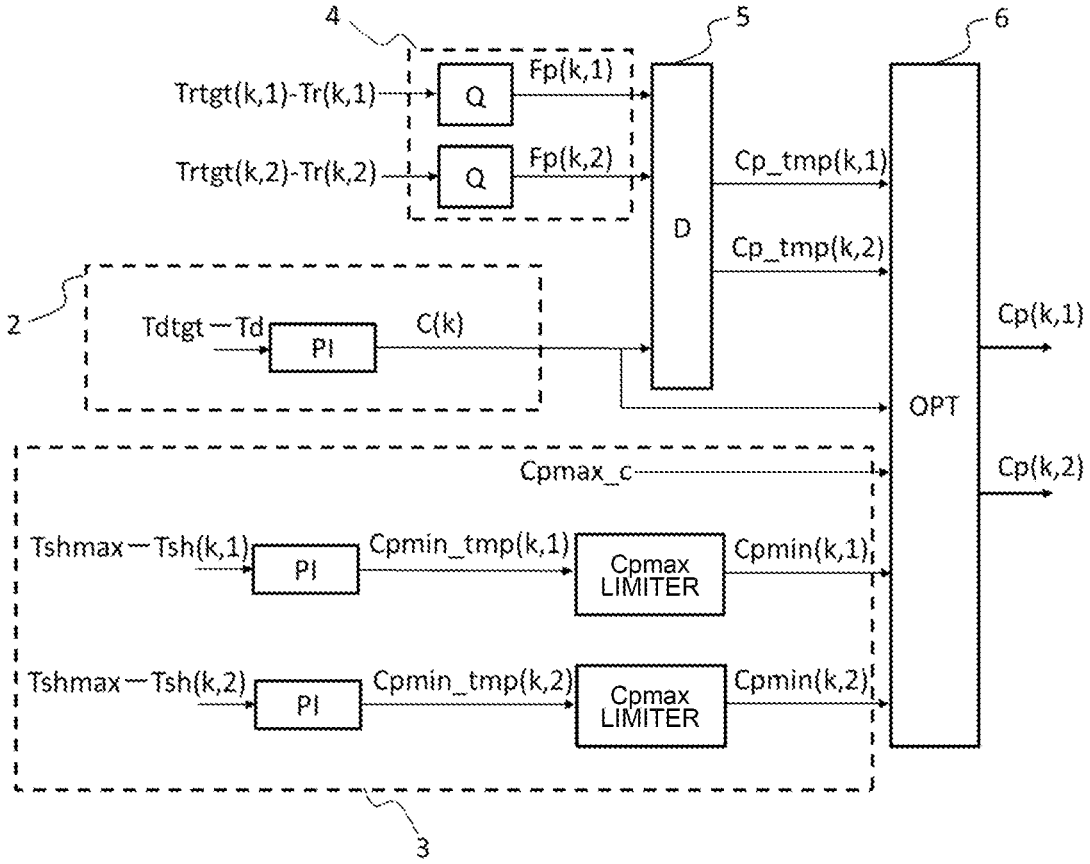
FIG. 5 is a block diagram regarding calculation of an opening degree of an electric expansion valve during a cooling operation in Embodiment 1 of the present disclosure.

FIG. 5 is block diagram for calculation of the opening degree of each electric expansion valve in Embodiment 1 of the present disclosure, and illustrates the controller 10 during the cooling operation. First, the electric expansion-valve total opening degree output unit 2 receives a discharge temperature deviation as an input, and determines the total opening degree of the electric expansion valves using an equation 6 and outputs the total opening degree as an electric expansion-valve total opening degree.

[Equation 6]

$$C(k)=Kp_C(Tdtgt(k)-Td(k))+Ki_C\Sigma_{l=0}{}^{k}(Tdtgt(l)-Td(l))Ts \quad (6)$$

In the equation, k is the discrete time, C is the electric expansion-valve total opening degree, $K_{pC}$ is a proportional gain, $K_{iC}$ is an integral gain, $T_{dtgt}$ is a target discharge temperature, $T_d$ is a room temperature, and $T_s$ is the control period.

In the above manner, since the discharge temperature is controlled by the controller including the integrator, it is possible to ensure that the discharge temperature approaches the target discharge temperature. Thus, since the discharge temperature is controlled with a high accuracy, it is possible to improve an energy saving performance and reduce a failure rate of the compressor.

The electric expansion-valve total opening degree output unit 2 as illustrated in FIG. 5 uses a PI controller; however, the control to be applied is not limited to the PI control. For example, the control to be applied may be an I control, a PID control, an LQI control, a model predictive control with an integrator, or a two-degree-of-freedom control, or may be a control method including upper and lower limits and anti-reset windup processing of an integrator in addition to basic configurations of the above controls. Furthermore, the degree of superheat on the suction side of the compressor, the degree of discharge superheat at the compressor, the degree of superheat or the degree of subcooling at an outlet of a representative indoor heat exchanger 105 may be controlled instead of the control of the discharge temperature.

The electric expansion-valve opening degree upper/lower limit calculation unit 3 first receives as an input, the difference between the maximum value of the degree of superheat that is determined in advance and the degree of overheat at the current time regarding each of the indoor heat exchangers 105, and determines a temporary lower limit opening degree of the electric expansion valve using an equation 7 and outputs the temporary lower limit opening degree as a temporary electric expansion-valve lower limit opening degree.

[Equation 7]

$$Cp\min_tmp(k, i) = Kp_{Cpmin}(Tsh\max_c - Tsh(k, i)) + Ki_{cpmin}\sum_{l=0}^{k}(Tsh\max_c - Tsh(1, i))Ts,\ i = 1, 2 \quad (7)$$

In the equation, k is the discrete time; i is a room number, and in this case, i is a room number of each of two rooms, $C_{pmin_tmp}$ is the temporary electric expansion-valve lower limit opening degree, $K_{pcpmin}$ is a proportional gain, $K_{icpmin}$ is an integral gain, $T_{shmaxc}$ is the maximum value of the degree of superheat of each at the indoor heat exchangers 105, $T_{sh}$ is the degree of superheat of each of the indoor heat exchangers 105, and $T_s$ is the control period.

In the above manner, the electric expansion-valve opening degree lower limit is calculated from the degree of superheat and the maximum degree of superheat, whereby it is possible to prevent the degree of superheat from being excessively great, and to avoid occurrence of a dew splash phenomenon and reduction of the heat exchange efficiency. Furthermore, it is required that the operation is performed at the maximum degree of superheat, though whether it is required or not depends on the condition. In view of this point, the integrator is provided, whereby it is possible to perform an operation for causing the degree of superheat to approach the maximum value heat, and thus achieve a control which is not conservative. The degree of superheat $T_{sh}$ may be determined as the difference between values obtained by temperature sensors provided close to the outlet and inlet of each of the indoor heat exchangers 105, or may be determined as the difference between an evaporating temperature that is obtained by conversion from a pressure sensor and a value obtained by the temperature sensor provided close to the outlet of the indoor heat exchanger 105.

The electric expansion-valve opening degree upper/lower limit calculation unit 3 as illustrated in FIG. 5 uses a PI controller; however, the control to be applied is not limited to the PI control. For example, the control to be applied may be an I control, PID control, an LQI control, a model predictive control with an integrator, or a two-degree of freedom control, or may be a control method including upper and lower limits and anti-reset windup processing of an integrator in addition to basic configurations of the above controls. Furthermore, in the case where it is not necessary to set the maximum value of the degree of superheat, it is unnecessary to use the controller such as the PI controller, and it suffices that the equation "$C_{pmin}$ (k, i)=$C_{pmin_c}$" is satisfied.

Each of the indoor heat exchangers 105 includes the degree-of-superheat sensor 109 that detects the degree of superheat, and the electric expansion-valve opening degree upper/lower limit calculation unit 3 determines a lower limit using an integrator based on, in the cooling cycle, the deviation between the upper limit of the degree of superheat and the degree of superheat.

Next, the temporary electric expansion-valve lower limit opening degree is applied as an input, and a lower limit of the opening degree of the electric expansion valve is determined by an equation 8 and is output as an electric expansion-valve lower limit opening degree.

[Equation 8]

$$Cp\min(k, i) = \begin{cases} Cp\min_c & \text{if } Cp\min_tmp(k, i) < Cp\min_c \\ Cp\max_c & \text{if } Cp\min_tmp(k, i) > Cp\max_c \\ Cp\min_tmp(k, i) & \text{otherwise} \end{cases} \quad (8)$$

In the equation, $C_{pmin_c}$ and $C_{pmax_c}$ are constants determined in advance. Therefore, the electric expansion-valve opening degree upper/lower limit calculation unit 3 outputs $C_{pmin_c}$ as the electric expansion-valve opening degree lower limit, and outputs $C_{pmax_c}$ as the electric expansion-valve opening degree upper limit.

The required-capacity calculation unit 4 is an element that calculates the required capacity from the room temperature deviation. To be more specific, the required-capacity calculation unit 4 calculates the required capacity for each room, using a value obtained by integrating the deviation between the room temperature and the target room temperature. The above partial frequency is also calculated from the room temperature deviation, and can be regarded as the required capacity of the associated indoor heat exchanger 105. Therefore, the partial frequency $F_p$ can be used as it is, as the output of the required-capacity calculation unit 4. Since the unit that calculates the partial frequency includes the integrator, a value corresponding to a load during an actual operation is output as the required capacity. Therefore, in the case where an influence by disturbance is reduced and each of the actuators operates within the range between the upper and lower limits, it is possible to ensure that each of the room temperatures is made to approach an associated target room temperature.

Furthermore, the frequency of the compressor 101 is the sum of the required capacities. Therefore, the frequency of the compressor 101 and the opening degree of the electric expansion valve are related to each other to improve the responsiveness of the room temperature control for each room.

Furthermore, the required-capacity calculation unit 4 calculates a lower limit of each of the required capacities in a subsequent step from the electric expansion-valve total opening degree, each of the electric expansion-valve opening degree lower limits, and each of the required capacities in the current step.

The temporary electric expansion-valve opening degree calculation unit 5 receives as inputs, the required capacities and the electric expansion-valve total opening degree, and determines the temporary opening degrees of the electric expansion valves using an equation 9 and outputs the temporary opening degrees as temporary electric expansion valve opening degrees. Even in the case where not all of the room temperatures can be made to approach the respective target room temperatures within the allowable operation range, the room temperature of a room having the greatest load can be made to follow an associated target room temperature, and it is possible to avoid a failure of cooling during the cooling operation and a failure of heating during the heating operation.

[Equation 9]

$$Cp_tmp(k, i) = C(k)\frac{Fp(k, i)}{F_tmp(k)} \quad (9)$$

In the equation, $C_{p_tmp}$ is the temporary expansion-valve opening degree. This means that the total opening degree of the electric expansion valves is divided into opening degrees and the opening degrees are assigned as the opening degrees of the electric expansion valves, based on a required frequency ratio. In an existing method, the total opening degree of electric expansion valves is divided into opening degrees and the opening degrees are assigned as the opening degrees of the electric expansion valves, based on a capacity ratio between the indoor heat exchangers 105; however, this existing method cannot reduce the influence by a disturbance, etc., during an actual operation, and it is not ensured that the room temperature is made to approach the target room temperature. Furthermore, according to another method, the value by which the total opening degree of electric expansion valves is increased/decreased in each step is divided into values and the values are assigned to the electric expansion valves, based on the capacities; however, in this method, the responsiveness is not satisfactory in a range in which the total opening degree of the electric expansion valves is stable and the value by which the total opening degree is increased/decreased is small. By contrast, in the embodiment of the present disclosure, the entire total opening degree of the electric expansion valves is divided into opening degrees and the opening degrees are assigned as the opening degrees of the electric valves, based on required capacities that change in an actual operation. It is therefore possible to promptly cause the room temperature to approach the target room temperature.

The electric expansion-valve opening degree calculation unit 6 is an element that formulates an optimization problem and finds solutions. A determination variable of the optimization problem is the electric expansion-valve opening degree. First, the evaluation function derivation unit 201 obtains an elevation function from the temporary expansion-valve opening degree using an equation 10 and outputs the elevation function.

[Equation 10]

$$J(Cp(k,1),Cp(k,2))=\Sigma_{l=1}^{2}(Cp_tmp(k,l)-Cp(k,l))^2 \quad (10)$$

In the equation, J is the evaluation function. In the above example, as an index for minimization, a Euclidean distance function that is a square of a Euclidean distance between the electric expansion-valve opening degree and the temporary electric expansion-valve opening degree is used. However, a distance defined by $L_p$ norm or the n-th power (n is positive value) of the distance defined by $L_p$ norm may be used, or an evaluation function with a regularization term may be used. The evaluation function derivation unit 201 uses the opening degree of each of the electric expansion valves as a variable to obtain a distance function with the temporary electric expansion-valve opening degree, as the evaluation function.

Next, the equality constraint derivation unit 202 obtains equality constraints from the electric expansion-valve total opening degree, using an equation 11. Although in this example, the equality constraints are used, constraints allowing a certain degree of error may be used, and the equality constraints include not only equalities but also pseudo equality constraints allowing a predetermined error.

[Equation 11]

$$\Sigma_{l=1}^{2}Cp(k,l)=C(k) \quad (11)$$

Finally, the inequality constraint derivation unit 203 obtains inequality constraints from the electric expansion-valve opening degree upper and lower limits, using an equation 12, and outputs the inequality constraints.

[Equation 12]

$$Cp\min(k,i)\leq Cp(k,l)\leq Cp\max_c, i=1,2 \quad (12)$$

Therefore, the optimization problem is formulated as an equation 13.

[Equation 13]

$$\min_{Cp(k,i),i=1,2}\sum_{i=1}^{2}(Cp_tmp(k,l)-Cp(k,l))^2 \quad (13)$$

$$\text{s.t.}\sum_{i=1}^{2}Cp(k,i)=C(k)$$

$$Cp\min(k,i)\leq Cp(k,i)\leq Cp\max_c, i=1,2$$

The optimization problem is a quadratic program problem, and the optimization problem calculation unit 204 can efficiently find solutions. As described above, the optimization problem is formulated, whereby it is possible to cause the discharge temperature to approach the target value, to avoid occurrence of a dew flying phenomenon and reduction of the efficiency that would be caused by an excessively great degree of superheat, and to bring the room temperatures close to the target room temperatures as much as possible. Furthermore, when the solutions are under the upper and lower limit constraints; that is, when the upper and lower limit constraints are inactive, it is ensured that the discharge temperature and the room temperatures approach the respective target values while keeping the degree of superheat within an allowable range. In the solutions, when the value of a certain element is a lower limit, the degree of superheat of an associated indoor heat exchanger 105 approaches the maximum value, the discharge temperature approaches the target discharge temperature, the room temperature of the indoor heat exchanger 105 other than the indoor heat exchanger 105 associated with the lower limit approaches the target room temperature, and the room temperature of the indoor heat exchanger 105 associated with the lower limit falls below the target room temperature, but the operation is performed to bring the room temperature close to the target temperature as much as possible.

Figure 6:
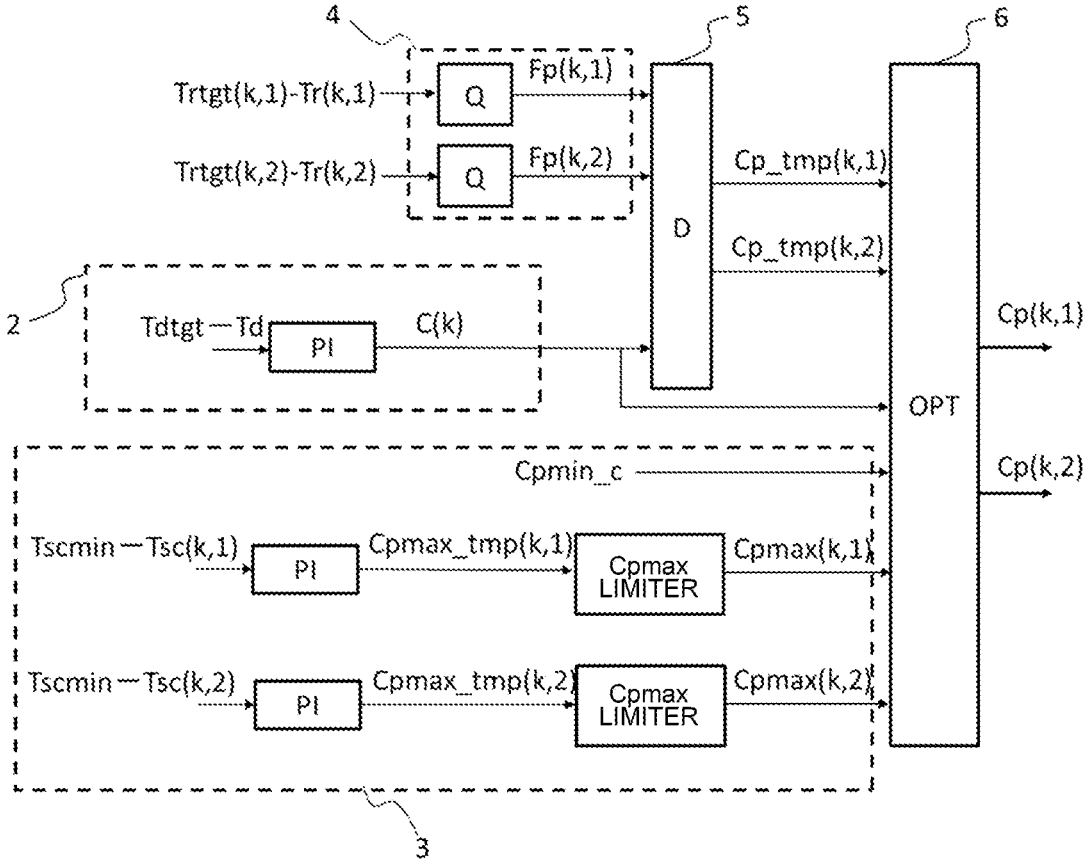
FIG. 6 is a block diagram regarding calculation of the opening degree of the electric expansion valve during a heating operation according to Embodiment 1 of the present disclosure.

FIG. 6 is a block diagram related to calculation of the electric expansion-valve opening degrees in Embodiment 1 of the present disclosure, and illustrates the controller 10 during the heating operation. FIG. 5 is referred to in the above description concerning the controller 10 during the cooling operation, whereas FIG. 6 is referred to in the following description concerning the controller 10 during the heating operation. The controller 10 controls the air-conditioning apparatus 1 by switching the configuration of the controller 10 between configurations illustrated by the block diagrams of FIGS. 5 and 6 when the operation of the air-conditioning apparatus 1 is switched to the cooling operation or the heating operation.

The elements other than the electric expansion-valve opening degree upper/lower limit calculation unit 3 are the same as those as illustrated in FIG. 5. Thus, the following description is made by referring mainly to the differences between the configurations as illustrated in FIGS. 5 and 6. The electric expansion-valve opening degree upper/lower limit calculation unit 3 receives as an input, the difference between the minimum value of the degree of subcooling and the degree of subcooling, and determines the upper limit of the opening degree of the electric expansion valve using an equation 14 and outputs the upper limit.

[Equation 14]

$$Cp\max_{tmp(k,i)}=Kp_{Cpmax}\Big((Tsc\min_c-Tsc(k,i))+Ki_{cpmax}\sum_{l=0}^{k}(Tsc\min_c-Tsc(l,i))Ts,\ i=1,2 \quad (14)$$

In the equation, k is the discrete time; i is a room number, and in this example, i is a room number of each of two rooms, $C_{pmax_tmp}$ is the temporary electric expansion-valve opening degree upper limit, $K_{pcpmax}$ is a proportional gain, $K_{icpmax}$ is an integral gain, $T_{scmin_c}$ is the minimum value of the degree of subcooling at each indoor heat exchanger 105, $T_{sc}$ is the degree of subcooling at each indoor heat exchanger 105, and $T_s$ is the control period.

The electric expansion-valve opening degree upper limit is calculated in the above manner, whereby the degree of subcooling can be controlled to be set greater than or equal to the lower limit, and to avoid generation of refrigerant sound that would be generated when two-phase refrigerant passes through the electric expansion valve. The degree of subcooling $T_{sc}$ may be determined as the difference between values obtained by temperature sensors provided close to the outlet and the inlet of each indoor heat exchanger 105, or may be determined as the difference between a condensing temperature that is obtained by conversion from the pressure sensor and a value obtained by the temperature sensor close to the outlet of each indoor heat exchanger 105.

The electric expansion-valve opening degree upper/lower limit calculation unit 3 as indicated in FIG. 6 uses a PI controller; however, the control to be applied is not limited to the PI control. For example, the control to be applied may be the I control, the PID control, the LQI control, the model predictive control with an integrator, or the two-degree of freedom control, or may be the control method including upper and lower limits and anti-reset windup processing of an integrator in addition to the basic configuration of the above controls. Furthermore, in the case where the minimum value of the degree of subcooling does not need to be set, it is unnecessary to use the controller such as the PI controller, and it suffices that the equation "$C_{pmax}(k, i)=C_{pmax_c}$" is satisfied.

Each of the indoor heat exchangers 105 includes the degree-of-subcooling sensor 110 that detects the degree of subcooling, and the electric expansion-valve opening degree upper/lower limit calculation unit 3 obtains, in the heating cycle, the upper limit with an integrator using the deviation between the lower limit of the degree of subcooling and the degree of subcooling.

Next, the temporary electric expansion-valve upper limit opening degree is applied as an input, and the electric expansion-valve upper limit opening degree is obtained using an equation 15.

[Equation 15]

$$Cp\max(k, i) = \begin{cases} Cp\max_c & \text{if } Cp\max_tmp(k, i) > Cp\max_c \\ Cp\min_c & \text{if } Cp\max_tmp(k, i) < Cp\min_c \\ Cp\max_tmp(k, i) & \text{otherwise} \end{cases} \quad (15)$$

In the equation, $C_{pmax_c}$ and $C_{pmin_c}$ are constants determined in advance. Therefore, the electric expansion-valve opening degree upper/lower limit calculation unit 3 outputs $C_{pmax_c}$ as the electric expansion-valve opening degree upper limit, and outputs $C_{pmin_c}$ as the electric expansion-valve opening degree lower limit. The optimization problem is formulated as indicated in an equation 16, using the electric expansion-valve opening degree upper and lower limits.

[Equation 16]

$$\min_{Cp(k,i), i=1,2} \sum_{l=1}^{2} (Cp_tmp(k, l) - Cp(k, l))^2 \quad (16)$$

$$\text{s.t.} \sum_{i=1}^{2} Cp(k, i) = C(k)$$

$$Cp\min_c \le Cp(k, i) \le Cp\max(k, i),\ i = 1, 2$$

The solution of the optimization problem is determined as the electric expansion-valve opening degree, whereby it is possible to cause the discharge temperature to approach the target value, to avoid generation of refrigeration sound and reduction of the efficiency that would be caused by an excessively small degree of subcooling, and to bring the room temperatures close to the target temperatures as much as possible. It should be noted that when the solution is under the upper and lower limit constraints, that is, when the upper and lower limit constraints are inactive, it is ensured that the discharge temperature and the room temperatures are made to approach the respective target values while keeping the degree of subcooling within an allowable range. In the solution, when the value of a certain element is a lower limit, the opening degree of an associated electric expansion valve approaches the minimum opening degree determined in advance, the discharge temperature approaches the target discharge temperature, the room temperature of the indoor heat exchanger 105 other than the indoor heat exchanger 105 associated with the lower limit approaches the target room temperature, and the room temperature of the indoor heat exchanger 105 associated with the lower limit exceeds the target room temperature, but the operation is performed to bring the room temperature close to the target temperature as much as possible.

As described above, the air-conditioning apparatus includes: room temperature sensors that detect room temperatures of respective rooms; target room-temperature setting units that set target room temperatures of the respective rooms; a variable displacement type compressor that causes refrigerant to sequentially circulate through an outdoor heat exchanger, electric expansion valves, and indoor heat exchangers; a required-capacity calculation unit that calculates each of required capacities for the respective rooms, using a value that is obtained by integrating a deviation of an associated one of the room temperatures from an associated one of the target room temperatures; an electric expansion-valve total opening degree output unit that outputs a total opening degree of the electric expansion valves, each of which is connected to an associated one of the indoor heat exchangers; a temporary electric expansion-valve opening degree calculation unit that calculates each of temporary opening degrees of the electric expansion valves for the respective rooms, using an associated one of the required capacities and a total opening degree; an evaluation function derivation unit that obtains a distance function with an associated one of the temporary opening degrees of the electric expansion valves as an evaluation function, using an associated one of the opening degrees of the electric expansion valves as a variable; an equality constraint derivation unit that obtains equality constraints for equalizing the sum of the opening degrees that is a variable to the total opening degree; an electric expansion-valve opening degree upper/lower limit calculation unit that calculates an upper limit and a lower limit of each of the opening degrees; an inequality constraint derivation unit that obtains inequality constraints in which each of the opening degrees falls within a range of the upper limit to the lower limit; and an optimization problem calculation unit that calculates each of the opening degrees by solving an optimization problem from the evaluation function, the equality constraints, and the inequality constraints.

Furthermore, the air-conditioning method includes: a room temperature detection step of detecting room temperatures of a plurality of rooms; a target room temperature setting step of setting target room temperatures of the plurality of rooms; a circulation step of causing refrigerant to sequentially circulate an outdoor heat exchanger, electric expansion valves, and indoor heat exchangers using a variable displacement type compressor; a required capacity calculation step of calculating each of required capacities for the plurality of rooms using a value that is obtained by integrating a deviation of an associated one of the room temperatures from an associated one of the target room temperatures; an electric expansion-valve total opening degree output step of outputting a total opening degree of the electric expansion valves, each of which is connected to an associated one of the indoor heat exchangers; a temporary electric expansion-valve opening degree calculation step of calculating each of temporary electric expansion-valve opening degrees for the plurality of rooms, using an associated one of the required capacities and the total opening degree; an evaluation function derivation step of obtaining a distance function with an associated one of the temporary opening degrees of the electric expansion valve as an evaluation function, using an associated one of the opening degrees of the electric expansion valves as a variable; an equality constraint derivation step of obtaining equality constraints for equalizing the sum of the opening degrees as a variable to the total opening degree; an electric expansion-valve opening degree upper/lower limit calculation step of calculating an upper limit and a lower limit of each of the opening degrees; an inequality constraint derivation step of obtaining inequality constraints in which each of the opening degrees falls within a range of the upper limit to the lower limit; and an optimization problem calculation step of calculating each of the opening degrees by solving an optimization problem from the evaluation function, the equality constraints, and the inequality constraints.

Therefore, it is possible to cause the room temperature deviation to approach the minimum value, while achieving a high-efficiency operation within the allowable driving range of the electric expansion-valve opening degree.

REFERENCE SIGNS LIST

1 air-conditioning apparatus 2 electric expansion-valve total opening degree output unit 3 electric expansion-valve opening degree upper/lower limit calculation unit 4 required-capacity calculation unit 5 temporary electric expansion-valve opening degree calculation unit 6 electric expansion-valve opening degree calculation unit 10 controller 11 storage device 12 arithmetic device

101 compressor 102 four-way valve 103 outdoor heat exchanger

104, 104*a*, 104*b* electric expansion valve 105, 105*a*, 105*b* indoor heat exchanger 106, 106*a*, 106*b* room temperature sensor 107, 107*a*, 107*b* target room-temperature setting unit 108 discharge temperature sensor 109, 109*a*, 109*b* degree-of-superheat sensor 110, 110*a*, 110*b* degree-of-subcooling sensor 201 evaluation function derivation unit 202 equality constraint derivation unit 203 inequality constraint derivation unit 204 optimization problem calculation unit

The invention claimed is:

1. An air-conditioning apparatus comprising:

room temperature sensors configured to detect room temperatures of respective rooms;

target room-temperature setting units configured to set target room temperature of the respective rooms;

a variable displacement type compressor configured to cause refrigerant to sequentially circulate through an outdoor heat exchanger, electric expansion valves, and indoor heat exchangers; and a controller configured to measure an opening degree of each of the electric expansion valves, the controller including a required-capacity calculation unit configured to calculate each of required capacities for the respective rooms using a value that is obtained by integrating a deviation of an associated one of the room temperatures from an associated one of the target room temperatures, an electric expansion-valve total opening degree output unit configured to output a total opening degree of the electric expansion valves, each of which is connected to an associated one of the indoor heat exchangers, a temporary electric expansion-valve opening degree calculation unit configured to calculate each of temporary opening degrees of the electric expansion valves for the respective rooms, using an associated one of the required capacities and the total opening degree, an evaluation function derivation unit configured to obtain a distance function with an associated one of the temporary opening degrees of the electric expansion valves, as an evaluation function, using an associated one of the opening degrees of the electric expansion valves as a variable, an equality constraint derivation unit configured to obtain equality constraints to equalize the sum of the opening degrees that is a variable to the total opening degree, an electric expansion-valve opening degree upper/lower limit calculation unit configured to calculate an upper limit and a lower limit of each of the opening degrees, an inequality constraint derivation unit configured to obtain inequality constraints in which each of the opening degrees meets falls within a range of the upper limit to the lower limit, and an optimization problem calculation unit configured to calculate each of the opening degrees by solving an optimization problem from the evaluation function, the equality constraints, and the inequality constraints.

2. The air-conditioning apparatus of claim 1, wherein the evaluation function is a Euclidean distance function.

3. The air-conditioning apparatus of claim 1, wherein each of the indoor heat exchangers includes a degree-of-superheat sensor configured to detect a degree of superheat, and in a cooling cycle, the electric expansion-valve opening degree upper/lower limit calculation unit determines the lower limit using an integrator based on a deviation between an upper limit of the degree of superheat and the degree of superheat.

4. The air-conditioning apparatus of claim 3, wherein each of the indoor heat exchangers includes a degree-of-subcooling sensor configured to detect a degree of subcooling, and in a heating cycle, the electric expansion-valve opening degree upper/lower limit calculation unit determines the upper limit using an integrator based on a deviation between a lower limit of the degree of subcooling and the degree of subcooling.

5. The air-conditioning apparatus of claim 1, wherein each of the indoor heat exchangers includes a degree-of-superheat sensor configured to detect a degree of superheat, and a degree-of-subcooling sensor configured to detect a degree of subcooling, and in a cooling cycle, the electric expansion-valve opening degree upper/lower limit calculation unit determines the lower limit using an integrator based on a deviation between an upper limit of the degree of superheat and the degree of superheat, and in a heating cycle, the electric expansion-valve opening degree upper/lower limit calculation unit determines the upper limit using an integrator based on a deviation between a lower limit of the degree of subcooling and the degree of subcooling.

6. The air-conditioning apparatus of claim 1, wherein a frequency of the compressor is determined from the sum of the required capacities.

7. The air-conditioning apparatus of claim 1, wherein the required-capacity calculation unit calculates a lower limit of the required capacity in a subsequent step from the total opening degree, the lower limit, and the required capacity in a current step.

8. An air-conditioning method comprising:

a room temperature detection step of detecting room temperatures of a plurality of rooms;

a target room temperature setting step of setting target room temperatures of the plurality of rooms;

a circulation step of causing refrigerant to sequentially circulate an outdoor heat exchanger, electric expansion valves, and indoor heat exchangers, using a variable displacement type compressor;

a required capacity calculation step of calculating each of required capacities for the plurality of rooms, using a value that is obtained by integrating a deviation of an associated one of the room temperatures from an associated one of the target room temperatures;

an electric expansion-valve total opening degree output step of outputting a total opening degree of the electric expansion valves, each of which is connected to an associated one of the indoor heat exchangers;

a temporary electric expansion-valve opening degree calculation step of calculating a temporary electric expansion-valve opening degree of each of the plurality of rooms by using the corresponding required capacity and the total opening degree;

an evaluation function derivation step of obtaining a distance function with the an associated one of the temporary opening degrees of the electric expansion valves as an evaluation function, using an associated one of the opening degrees of the electric expansion valves as a variable;

an equality constraint derivation step of obtaining equality constraints to equalize the sum of the opening degrees as a variable to the total opening degree;

an electric expansion-valve opening degree upper/lower limit calculation step of calculating an upper limit and a lower limit of each of the opening degrees;

an inequality constraint derivation step of deriving inequality constraints in which each of the opening degrees falls within a range of the upper limit to the lower limit; and an optimization problem calculation step of calculating each of the opening degrees by solving an optimization problem from the evaluation function, the equality constraints, and the inequality constraints.

* * * * *